United States Patent [19]

Bergee

[11] 4,078,797

[45] Mar. 14, 1978

[54] FAST-ACTION SOCCER GAME

[76] Inventor: Mark A. Bergee, 5808 Ashcroft Ave., Edina, Minn. 55424

[21] Appl. No.: 708,103

[22] Filed: Jul. 23, 1976

Related U.S. Application Data

[63] Continuation-in-part of Ser. No. 656,786, Feb. 10, 1976, abandoned.

[51] Int. Cl.[2] ..... A63F 7/10

[52] U.S. Cl. ..... 273/85 D; 273/DIG. 23

[58] Field of Search ..... 273/85 C, 85 D, DIG. 23; 428/902, 36, 367

[56] References Cited

U.S. PATENT DOCUMENTS

| | | | |
|---|---|---|---|
| 3,870,303 | 3/1975 | Patterson, Jr. | 273/85 D |
| 3,889,951 | 6/1975 | Schaefer et al. | 273/DIG. 23 |
| 3,926,432 | 12/1975 | Furr et al. | 273/85 D |
| 3,931,970 | 1/1976 | Cecchetti | 273/85 D |
| 3,953,637 | 4/1976 | Phillips | 273/DIG. 23 |
| 3,972,529 | 8/1976 | McNeil | 428/36 |
| 4,000,896 | 1/1977 | Lauraitis | 273/DIG. 23 |

FOREIGN PATENT DOCUMENTS

| | | | |
|---|---|---|---|
| 1,034,971 | 4/1953 | France | 273/85 D |
| 1,201,648 | 8/1970 | United Kingdom | 273/DIG. 23 |
| 1,261,541 | 1/1972 | United Kingdom | 273/DIG. 23 |

OTHER PUBLICATIONS

Super-Strong Graphite, *Popular Science,* Apr. 1975, pp. 73–75.

Space Age Bowmaking, *Archery Magazine,* June 1974, pp. 10–13.

The 'R' in RP, More Than Just Glass, *Modern Plastics,* Mar. 1976, pp. 42–43.

*Primary Examiner*—Harland S. Skogquist

*Assistant Examiner*—Harry G. Strappello

[57] ABSTRACT

The soccer-type game includes a simulated playing field having a goal at each end into which a ball is to be "kicked" by any one of a number of small plastic players. The players are mounted on various laterally extending shafts journaled in spaced side walls so that the shafts can be shifted or slid transversely to bring selected players into optimum kicking positions and then rocked or rotated to cause a given player to kick the ball toward one goal or the other. The shafts are of a tubular construction composed of a polyester matrix containing graphite fibers, a lead insert being used to impart a desired and uniform mass to a given set of shafts.

5 Claims, 5 Drawing Figures

FAST-ACTION SOCCER GAME

CROSS-REFERENCE TO RELATED APPLICATION

This is a continuation-in-part of my application, Ser. No. 656,786, filed Feb. 10, 1976, now abandoned.

BACKGROUND OF THE INVENTION

1. Field of the Invention

This invention relates generally to games, and pertains more particularly to a soccer-type game in which the various players can be moved into various playing positions for the purpose of kicking a ball toward a goal at either end of a simulated playing field.

2. Description of the Prior Art

Various types of table games have been devised in the past for simulating soccer. The more rapidly such a game can be played, the more challenging and exciting it becomes. The main drawback with the currently popular game with which I am familiar stems from the use of relatively heavy supporting rods on which the various players are mounted. Where players prefer lighter weight rods, rods possessing too much mass, not only slow down the game action but cause the persons playing the game to experience greater fatigue. Prior art attempts to reduce the mass of such parts has resulted in increased fragility of such parts, particularly with respect to bending thereof. Such impairment, quite obviously, adversely affects the precision of play accompanied by a loss of interest, especially as far as skilled participants are concerned. The problem has proved to be particularly troublesome where the games are of the coin-operated variety which are usually subjected to constant use and, in many instances, abuse. While heavy rods appeal to some players, the mass is not the same for each rod for a given table, the longer rods obviously being heavier than the shorter ones. The lack of mass uniformity between rods of a set can be annoying, especially to those who have developed an advanced stage of proficiency.

SUMMARY OF THE INVENTION

Accordingly, a general object of the present invention is to maintain, and in most cases increase, the participants' interest in the playing of soccer-type games. More specifically, an aim of the invention is to make it possible to play such games considerably faster than heretofore.

Another object of the invention is to preserve the precision capabilities of a soccer-type game, virtually obviating the likelihood of damage occurring, even when the game is subjected to severe use and even misuse.

Yet another object of the invention is to provide a soccer-type game that will be less expensive to manufacture and will require little or no maintenance, thereby decreasing the cost of enjoying such a game throughout a period of time. Not only does my invention minimize any need for replacing parts, but it eliminates the need for lubrication as well.

Also, an aim is to use only a simple type of bearing for journaling the shafts constructed in accordance with this invention, yet permitting facile shaft movement without resort to supplemental lubrication.

Still another object is to minimize the fatigue that has accompanied the playing of games of this type.

Further, an object is to provide not only a set of shafts having a desired mass but a set in which the mass is uniform from one shaft to another, irrespective of length. Also, it is within the purview of my invention to permit an easy realization of not only the magnitude of the mass itself, but a facile achieving of the uniformity of whatever mass is selected.

Still another object of the invention is to provide a soccer-type game that possesses an overall pleasing appearance. Actually, chromium plated rods are commonly used but become chipped and unsightly; my invention avoids the use of such rods, instead employing attractive shafts having an inherent low luster which are virtually damage-proof.

Because the parts mentioned above reflect light, and the resulting glare has proved objectionable to participants, a further object of the invention is to provide better contrast between the supporting parts and the balls; more specifically, it is contemplated that the balls still be white and the various shafts utilized in supporting the plastic players be dark, suitably pigmented to as to provide an attractive color such as gray, so that the contrast makes it easier to follow the rapidly moving ball from point to point on the simulated playing field.

Another object is to permit the revamping of existing games of this type so that the benefits derived from a practicing of my invention can be realized.

Briefly, my invention contemplates the provision of extremely lightweight and sturdy shafts on which the players are mounted. In this regard, each shaft is of generally tubular construction. In one embodiment each shaft is comprised of a number of individual tubular sections having their adjacent ends connected by cylindrically configured plug members on which the plastic players are mounted. In a second embodiment, each shaft, although tubular, is of one-piece construction. The latter embodiment lends itself very readily to having the proper amount of lead placed therein in order to produce a shaft having a desired mass and also for compensating for mass differences attributable to shaft length. Also, shafts, when fabricated in accordance with the teachings of my invention, can be rapidly moved into various positions relative to the table's playing surface and then rotated so as to cause the particular plug-mounted player to kick the ball toward the appropriate goal. The tubular shafts are formed of polyester resin having graphite fibers contained therein. It is also within the scope of the invention to utilize aramid fibers in combination with graphite fibers. The connecting plug members used in the first embodiment are of polyester impregnated with glass fibers. Because of the relatively low mass or weight of the foregoing material and its increased strength, the action of a soccer-type game when equipped with my shaft construction allows the game to be played with far greater proficiency and with appreciably less fatigue than up to now. In addition, the shaft construction permits it to be tailored to the specific whims and likes of a particular player, thereby enabling that player to perform at his very best.

DESCRIPTION OF THE PREFERRED EMBODIMENTS

Figure 1:
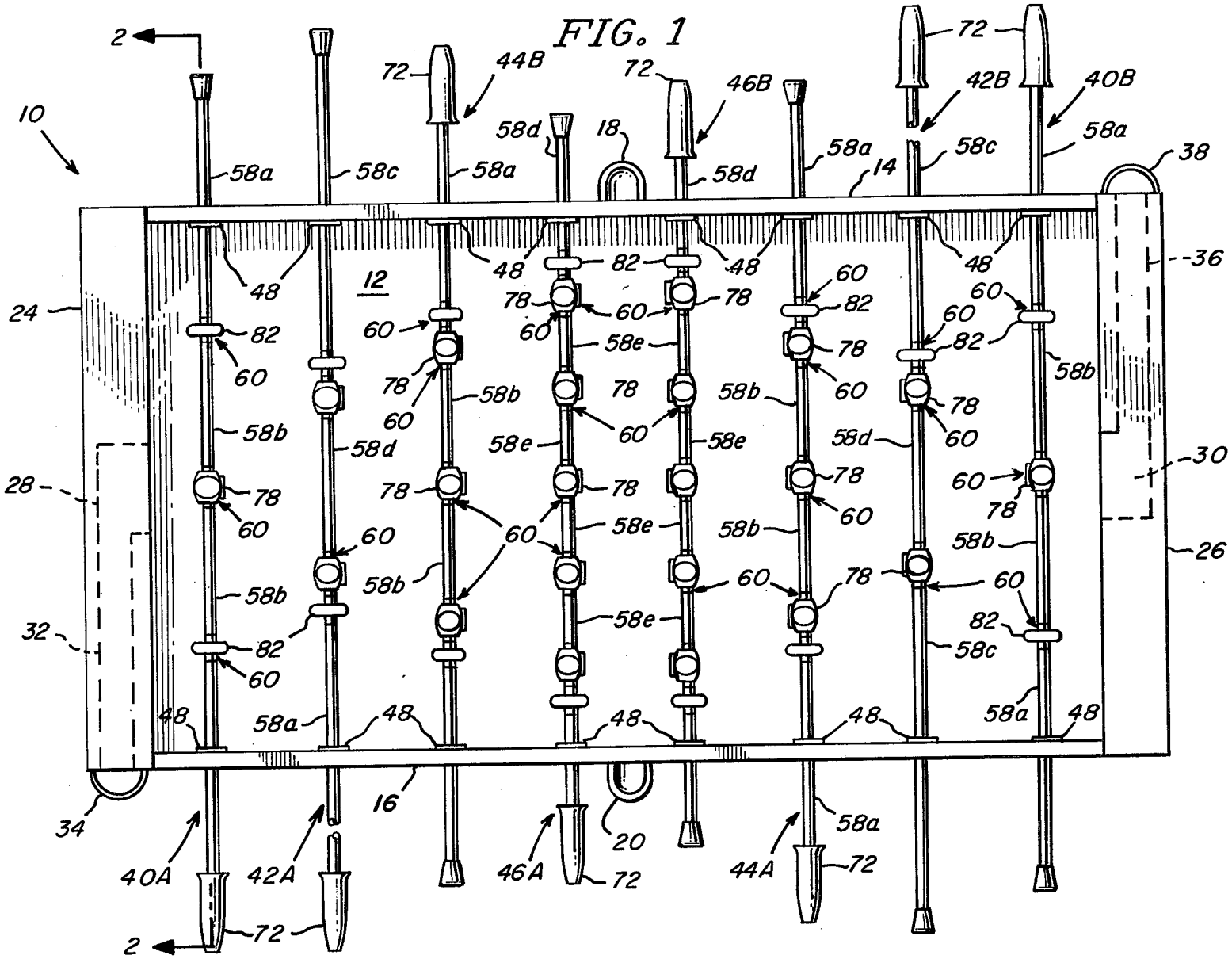
FIG. 1 is a top plan view of a table for playing a soccer-type game in accordance with the teachings of my invention.

A soccer-type game exemplifying my invention comprises a table denoted generally by the reference numeral 10 having a miniaturized playing field or area 12. Extending along the sides of the playing field 12, being part of the table 10, are upstanding side walls 14 and 16, the side wall 14 having a ball drop 18 and the side wall 16 having a ball drop 20 which are used to introduce a small white ball 22 onto the playing field 12. At opposite ends of the field 12 are walls 24 and 26. The end walls 24 and 26 contain therein goals labeled 28 and 30, respectively. From FIG. 1 it will be appreciated that the goal 28, when the ball 22 enters therein, is discharged via a passage 32 into a ball return 34 where it can be picked up and replayed. Similarly, the goal 30 has a passage 36 leading therefrom to a ball return 38 on the opposite side of the table.

Playing a very important role as far as my invention is concerned are a plurality (eight being depicted) of transversely directed shafts 40A, 42A, 44A, 46A and 40B, 42B, 44B and 46B. As will presently be made manifest, these shafts 40A–46B are generally similar, but differing somewhat, as will be explained below.

The shafts 40A–46B are journaled for sliding and rotative movement in plastic bearings 48, preferably nylon. Each bearing, as can be perceived from FIG. 2, includes a sleeve or bushing 50 and a flange 52 for attachment to the inner surface of either the side wall 14 or 16 by means of screws 54. The sleeve or bushing portions 50 of the bearings 48 extend into circular holes 56 formed in the side walls 14, 16.

Figure 2:
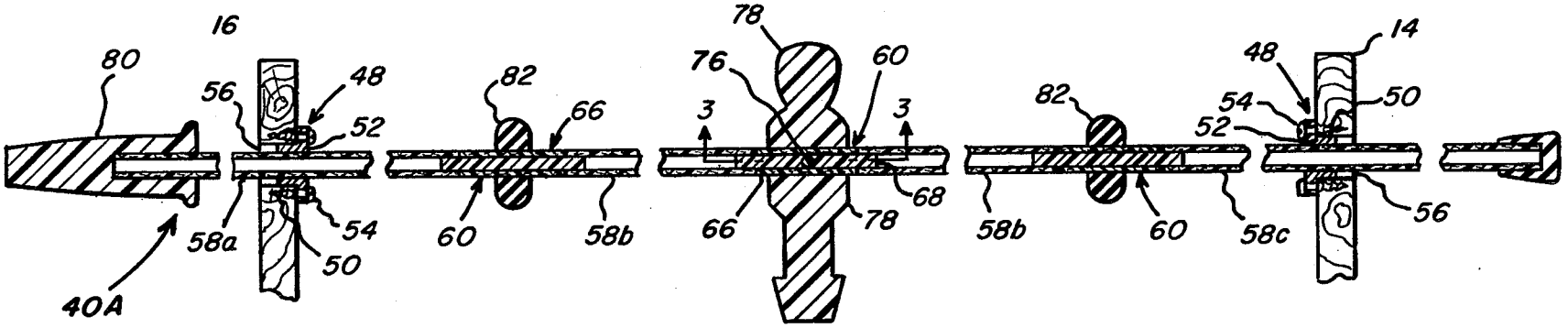
FIG. 2 is a sectional view taken in the direction of line 2—2 in FIG. 1.

Describing now in detail the particular shaft denoted by the reference numeral 40A, it will be discerned from FIG. 2 that this shaft is comprised of four tubes **58*a*, 58*b* and three connecting plugs 60 of identical construction. The tubes 58*a*** are of the same length so have the same suffix "*a*"; the tubes **58*b*** are of the same length so have the same suffix "*b*". It might be pointed out at this time that the shaft 40B is identical to the shaft 40A. The remaining shafts 42A, 44A, 46A, 42B, 44B and 46B are quite similar, but composed of different numbers of tubes 58 (also differing in length) and plugs 60. The tubes 58 of the remaining shafts have been distinguished from the sections **58*a*, 58*b*** by different letter suffixes, the same suffixes denoting sections of equal length.

The composition of the various tubes 58 is extremely important as far as realizing the benefits of my invention. In this regard, the material constituting the parts just alluded to is composed of randomly oriented graphite fibers, rendering the shaft 40A, as well as the other shafts 40B–46B, virtually indestructible and immune to bending from even the most severe forces that might be applied to the unsupported span between the side walls 14, 16. Aramid fibers can be used in lieu of some of the graphite fibers.

The graphite fibers have been labeled 62 (FIG. 3), and it is intended that the fibers 62 comprise between 50–70 percent of the total weight constituting the elements **58*a*, 58*b*. The remainder of these parts constitutes a plastic matrix 64 (also FIG. 3), more specifically polyester resin; the polyester would then be between 30–50 percent of the weight of the tubes 58. The preferred percentage of fibers 62 is approximately 70% of the total weight, so consequently the preferred percentage of polyester resin would be 30%. Although a tube formed of graphite fibers and polyester is exceedingly durable, being quite rigid, a lighter weight shaft 58 can be produced by substituting aramid fibers for some of the graphite ones. In such a case, for an optimum weight and strength, it is planned that the mixture of fibers 62 contain approximately 60% aramid and approximately 10% graphite. Thus, on an overall weight basis, the shaft parts comprising the tubes 58 would, under these conditions, preferably consist of 60% aramid fibers, 10% graphite fibers and 30% polyester. It might be pointed out at this time that aramid fibers are currently being marketed by E. I. Dupont DeNemours & Co. of Wilmington, Delaware under the trademark Kevlar-49**.

Figure 3:
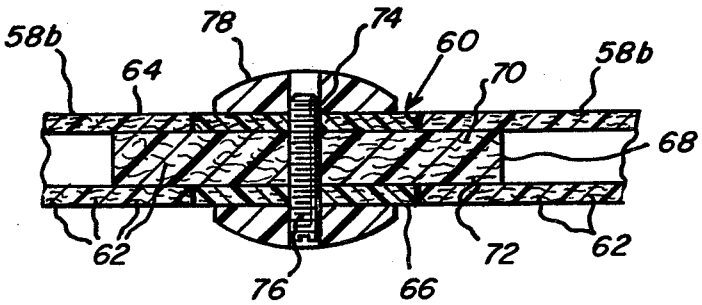
FIG. 3 is an enlarged sectional detail taken in the direction of line 3—3 of FIG. 2.

Describing the plugs 60 with greater particularity, they are comprised of a tube 66 with a rod 68 secured therein by means of an appropriate adhesive. The tubes are considerably shorter than the tubes 58 as will presently be appreciated. The ends of the rod 68, in each instance, projects from the ends of its tube 66 so that the projecting ends, as best seen in FIG. 3, extend into the ends of the adjacent tubes 58. Here again, an appropriate adhesive is employed in order to attach the ends of the tube 66 and the rod 68, and hence the plug 60, to the adjacent ends of the tubes 58.

As for the composition of the plugs 60, both the tube 66 thereof and the rod 68 received therein contain glass fibers 70 impregnated in a polyester resin matrix 72. Owing to the relatively small size of the plugs 60, the ratio of glass fibers to polyester is not as important as the composition of the tubes 58. However, the glass fibers should constitute about 30% and the polyester about 70% on a weight basis.

Thus, when assembling the shaft 40A, the ends of the rod 60 are inserted into an open end of one tube **58*a*, an appropriate adhesive being used, as indicated above, so as to assure that the parts will remain together. The other end of the rod 60 is inserted into the next tube 58*b***, a suitable adhesive again being employed, and one end of the rod, and so on to construct each shaft.

In order to make the shaft 40A interchangeable with shafts or rods already in use on existing soccer-type games, it is preferable that the outside diameter of the various tube sections be $\frac{5}{8}$ inch and the inside diameter be $\frac{3}{8}$ inch, thereby providing a tubular wall thickness of $\frac{1}{8}$ inch. The outside diameter of the tubes 66 is also $\frac{5}{8}$ inch and their inside diameters $\frac{3}{8}$ inch. Consequently, the rods 68 would have a diameter of $\frac{3}{8}$ inch so as to fit within the ends of the various tubes 58. All of the interfitting joints of the other shafts 40B–46B should be bonded in the same fashion that has been mentioned in connection with the joining of the tubes **58*a*, 58*b* and the rods 68 of the plugs 60**.

The central plug 60, using the shaft 40A as an example, has a hole 74 extending diametrically therethrough for the purpose of accommodating a screw 76. The plugs 60, by reason of their composition, permit the hole 74 to be formed therein, whereas this cannot be readily done, either by drilling or molding procedures now available, as far as the aramid/graphite-containing tubes 58 are concerned. The screw 76 also, as can be perceived from FIG. 3, extends through the particular "player" or figure 78 to be held in place on the shaft 40A, more specifically on the tube 66 of the central plug 60. A hand grip 80 is fitted over one end of the shaft 40A so that the shaft can be both transversely and rotatively maneuvered in its nylon bearings 48.

Encircling the tubes 66 of the other two plugs employed in the construction of the shaft 40A is a resilient bumper disc 82. These discs 82 merely limit the transverse shifting of the shaft 40A, one disc 82 striking the side wall 14 in one instance and the other disc 82 striking the side wall 16 in the other.

The manner of playing the soccer-type game just described should be readily apparent. When the ball 22 has been introduced via the ball drop 18 or 20 onto the playing field 12 of the table 10, it rolls into any number of positions between the shafts 46A, 46B and it is up to the participant on the "A" side of the table 10 to grasp the hand grip 80 on the shaft 46A and the participant on the "B" side to grasp one of the handles 80 on the "B" side in order that the most appropriate playing figure 78 on the shafts 46A or 46B is moved into "kicking" position with respect to the ball 22.

One happenstance position of the ball 22 is depicted in FIG. 2. To position the player or figure 78, as shown, requires considerable dexterity (but even more is demanded thereafter as the ball 22 is repeatedly blocked and kicked by the various figures 78). The shaft 46A (and the others), owing to its composition, is quite lightweight, possessing only a relatively small amount of mass compared to steel, and because of its lower inertia, can be rapidly shifted back and forth in whatever transverse direction is needed in order to position the proper playing figure 78 into a blocking and kicking position. Once the proper relation has been achieved, then the hand grip 80 on the shaft 46A is rotated so as to impart a kicking action to the ball 22, doing so through the agency of the particular figure 78 that has been juxtaposed with respect to the ball 22 at that moment. This gets the ball 22 in motion.

The first kick should propel the ball 22 toward the goal 30, possibly passing between other figures 78 on its way. Then it is up to the participant on the B side to position a figure 78, say, on the shaft 40B, so as to block the ball 22 from entering the goal 30. This can only be done by reciprocally shifting the shaft 40B so that the particular figure 78 thereon is in obstructive alignment with the ball 22. Immediately thereafter, the B participant must rotate or rock the shaft 40B so as to cause the playing figure 78 mounted thereon to kick the ball 22 back in the opposite direction, that is toward the other goal 28.

It should be obvious that the game is made far more exciting when played at a rapid pace. The lightweight construction of the various shafts 40A–46B enables the participants to do this. Very little time exists for each shifting or sliding operation. Once it is recognized that the proper player position has been reached, the shaft 40 carrying that figure 78 must then be quickly rocked by rotating the shaft so as to kick the ball 22. It is imperative for good playing results that the participants react quickly to ever changing ball positions, the response time needed for constantly manipulating the shafts 40 is equally important.

Because of the relatively low coefficient of friction possessed by the composition of the shafts 40A–46B, very little resistance is encountered in achieving the three dimensional movement needed to position the various figures 78 via the transverse and rotative movements just described. Having the bearings 48 of nylon contributes even more to preventing a virtually friction-free movement of the various shafts 40A–46B. No lubricant, such as silicon, need be applied to the shafts 40 or bearings 48.

Also, it should be recognized that the rigidity and strength of the various shafts 40A–46B makes it such that even when these shafts are subjected to various deflective forces they will not bend, at least to any significant or noticeable degree, and will never become permanently bowed. Therefore, the various axes on which the shafts 40A–46B are mounted for sliding and rotative movement remain in accurate parallelism so that precise shots can be made as far as the ball 22 is concerned, thereby enabling the more skillful participants to prevail.

Since game tables of this type are illuminated in a variety of ways, it being almost impossible to have the light perfect for all shots, my invention lends itself readily to making the various shafts 40A–46B of a contrasting color with respect to the ball 22. The ball 22 is usually white so a darker color, such as gray, is highly desirable. Also, since glare frequently results from the overhead lights, the darker the color, the less the reflection. It will be appreciated that polyester resin can be readily dyed to almost any color, so the matrices 64 and 72 can have the desired pigments added thereto to present whatever color is desired.

Figure 4:
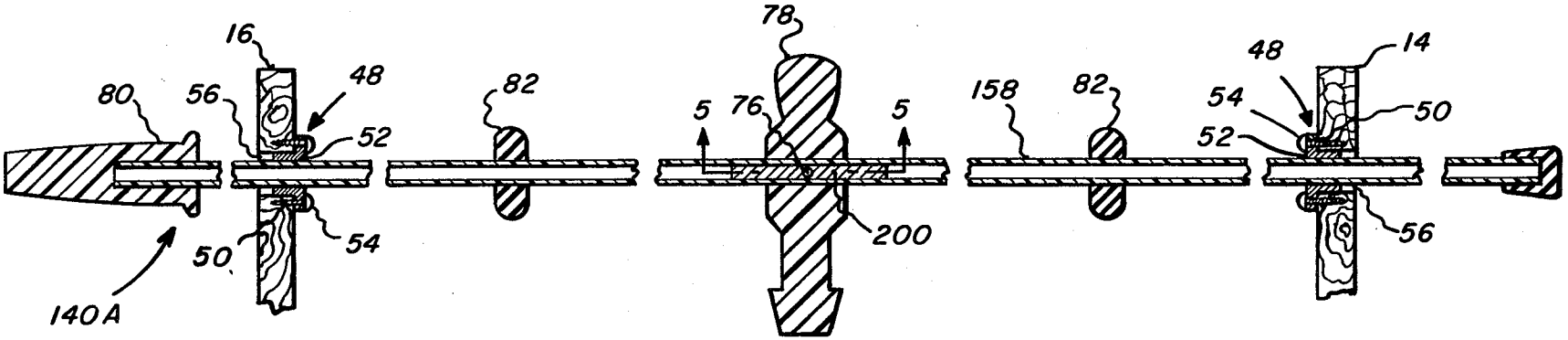
FIG. 4 is a sectional view corresponding generally to FIG. 2 but depicting a one-piece tubular shaft.
Figure 5:
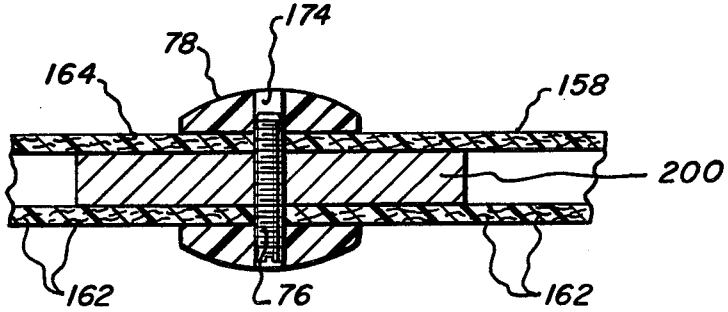
FIG. 5 is an enlarged sectional detail taken in the direction of line 5—5 of FIG. 4.

Having presented the foregoing detailed description of one embodiment, a second embodiment will now be described, although in lesser detail because the first embodiment amply backgrounds what will now be presented. Owing to the general similarity, it will be helpful to use, where possible, the same reference numerals for the same parts and, where possible, a prefix of "1", that is one hundred, for parts having substantial similarity. Thus, the shaft depicted in FIG. 4 has been given the reference numeral 140A. Instead of being comprised of four tubes 58, however, the unitary shaft 140A comprises a single tube 158. While this shaft 140A would have a length intermediate the shortest, such as a one-piece shaft corresponding to the composite shaft 46A or 46B (on the order of 42–11/16 inches), and the longest, such as a one-piece shaft corresponding to the composite shaft 42A or 42B (on the order of 52½ inches), the construction of each shaft 140 of a set of one-piece tubes 158 should be fabricated of a material imparting considerable rigidity thereto. Therefore, it is planned that all of the fibers 162 (FIG. 5) be graphite. More specifically, it is intended that the fibers 162 comprise between 50–70 percent of the total weight constituting the tube 158, the remainder constituting a plastic matrix 164, more specifically polyester resin. The polyester would then be between 30–50 percent of the weight of the tube 158. The preferred percentage of fibers 162 is approximately 70% of the total weight, so consequently, the preferred percentage of polyester would be 30%, as in the earlier described embodiment of FIGS. 1–3.

Although the tube 158 would be somewhat heavier than when using aramid fibers, it is still appreciably lighter than conventional metal rods. Because some players prefer a relatively heavy shaft, the modification now being described lends itself to being made just about as heavy as any player would want by resort to a dense filler material, preferably lead because it has a specific gravity of 11.34, is inexpensive, and quite ductile. Consequently, lead can be formed into rods having a diameter on the order of ⅜ inch (assuming an inside diameter of ⅜ inch for the tube 158). A metal filler or insert 200 of lead can be placed within the tube 158. If the mass of the resulting shaft 140A is to be increased, say, two pounds over the mass of just the tube 158 itself, then the length of lead insert 200 would be on the order of three inches. If four pounds are to be added, then the length would be approximately six inches. The point is that virtually any amount of mass can be added, depending on what the player wants. Also, even though the shafts vary in length, as far as a set of such shafts is concerned for a playing field 12, the mass thereof can readily be made the same for each shaft via the simple expedient of using an insert or filler 200 having an appropriate length of the mass that is desired. Yet, if he prefers, he can have a shaft 140A that is extremely lightweight, such as when devoid of any lead whatsoever.

Once inserted, the lead insert 200 can be prevented from moving within the tube 158 by the screw 76 which anchors the playing figure 78, the screw in this instance residing in a hole 174 that extends through the lead insert 200 in contradistinction to the rod 68 forming part of the plug 60 in FIGS. 2 and 3.

I claim:

1. In a soccer-type game, a simulated playing field having a goal at each end and spaced side walls, a plurality of transverse tubular shafts, at least some of which shafts differ in length with respect to other of said shafts, the tubular shafts comprising a material containing graphite fibers therein, said tubular shafts being journaled for sliding and rotative movement about generally parallel axes above said playing field, at least one figure member mounted on each shaft, and at least one metal insert contained within the shortest of said shafts, whereby anyone of said tubular shafts can be shifted in opposite transverse directions to move the particular figure member mounted thereon into selected playing positions and that particular shaft then rotated or rocked to cause the positioned figure member to kick a ball element toward one of said goals.

2. A soccer-type game as set forth in claim 1 in which said material also includes a plastic matrix, said graphite fibers being dispersed throughout said matrix.

3. A soccer-type game as set forth in claim 2 including a metal insert contained within each of said shafts.

4. A soccer-type game as set forth in claim 2 in which each of said inserts is of lead.

5. A soccer-type game as set forth in claim 4 including a set screw extending at least partially through each of said figure members, through said tube and through each of said lead inserts.

* * * * *